United States Patent [19]

Van Vessem et al.

[11] 4,112,350

[45] Sep. 5, 1978

[54] NEGATIVE AND POSITIVE SWITCHING IGNITION SIGNAL CONDITIONER

[75] Inventors: Thomas G. Van Vessem, Enfield; Paul R. Back, Somersville, both of Conn.

[73] Assignee: United Technologies Corporation, Hartford, Conn.

[21] Appl. No.: 833,633

[22] Filed: Sep. 15, 1977

[51] Int. Cl.[2] ..... F02P 17/00

[52] U.S. Cl. ..... 324/16 R

[58] Field of Search ..... 324/16 R, 15

[56] References Cited

U.S. PATENT DOCUMENTS

| | | | |
|---|---|---|---|
| 3,543,143 | 11/1970 | Wanninger | 324/16 R |
| 4,074,183 | 2/1978 | Voross | 324/16 R |

OTHER PUBLICATIONS

Levitre et al., Method for Ignition Breaker Points, Capacitor Testing, & Servicing Decisions, IBM Tech. Discl. Bull., Mar. 1971, p. 3189.

*Primary Examiner*—Stanley T. Krawczewicz
*Attorney, Agent, or Firm*—M. P. Williams

[57] ABSTRACT

The signal indicative of switching of the ignition primary coil of a spark ignition engine is conditioned by means of compatible, combined, multiple and variable threshold testing of both the high end and the low end of the coil primary, without need to know (or alter operation in dependence upon) whether the engine employs positive switching at the high end of the primary coil or negative switching at the low end of the primary coil. To sense the end of the dwell period, the high coil voltage is compared against a negative voltage which will never occur if low coil switching is employed, but which will occur at the start of firing time in a positive switching system. Similarly, low coil is compared against a positive voltage which would never occur in a positively switched system, but which does occur at the start of firing time if negative switching is used. The circuits recognizing the start of dwell time require both that high coil be in excess of some low voltage and that low coil be less than some fraction of battery voltage; when positive switching is used, low coil is always at or near ground and therefore always meets the test; when negative switching is used, high coil is always at battery and therefore always meets the test.

2 Claims, 4 Drawing Figures

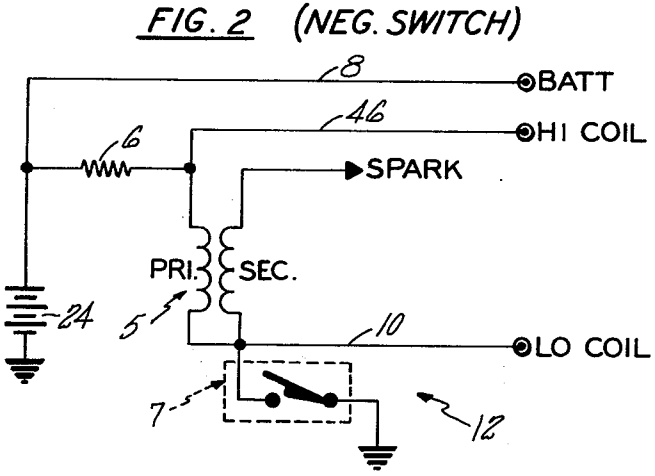
FIG. 2 (NEG. SWITCH)
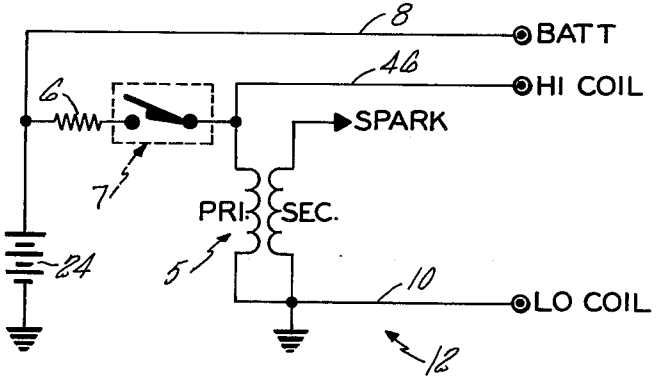
FIG. 3 (POS. SWITCH)
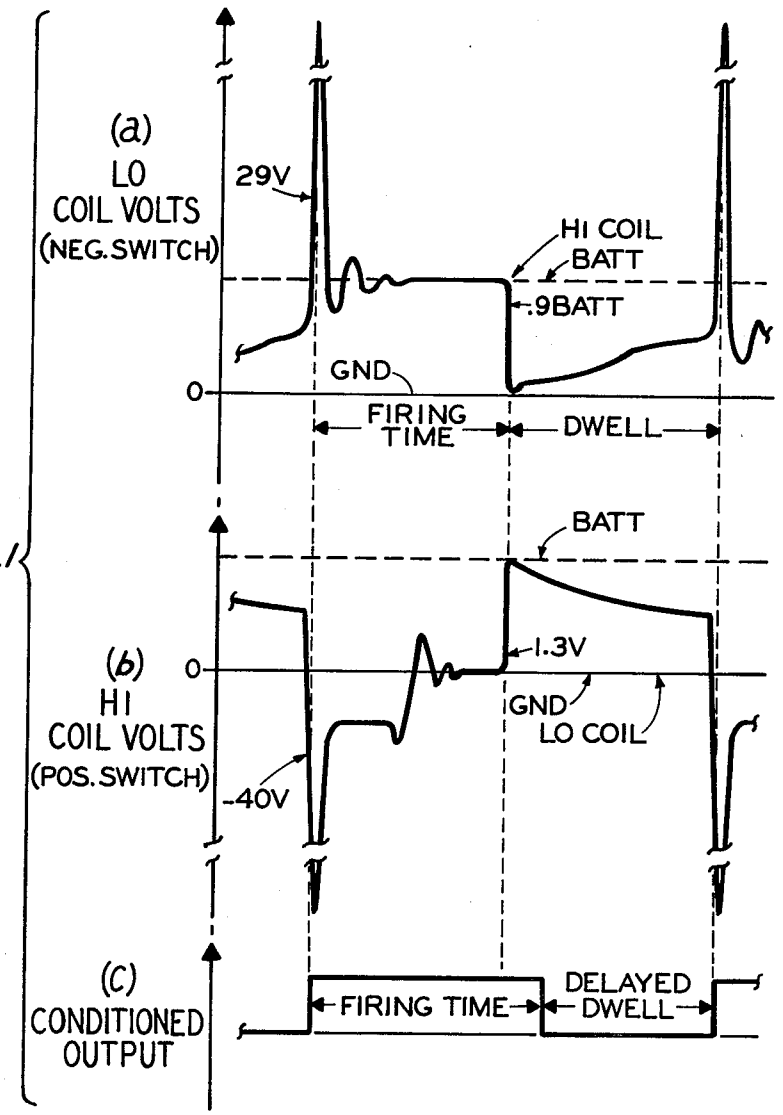
FIG. 1

NEGATIVE AND POSITIVE SWITCHING IGNITION SIGNAL CONDITIONER

CROSS REFERENCE TO RELATED APPLICATIONS

The subject matter herein is an improvement on our commonly owned copending application, Ser. No. 829,857 filed on Sept. 1, 1977, entitled DUAL THRESHOLD LOW COIL SIGNAL CONDITIONER.

BACKGROUND OF THE INVENTION

1. Field of Art

This invention relates to diagnostics of spark ignition engines, and more particularly to compatible conditioning of vehicle coil primary signals, whether positively or negatively switched.

2. Description of the Prior Art

In our aforementioned copending application, the end of the dwell period of a spark ignition engine is recognized by a high voltage, spark creating swing in the low coil signal (the voltage at the ground-interrupted end of the ignition coil primary) determined from comparison with a first, fixed threshold voltage which is between the current limited voltage variations which can occur among modern electronic high voltage ignition systems and a low peak primary voltage which could be expected to be achieved with the ignition defeated, for spark analysis diagnostic procedures with the engine cranking. The system of the aforementioned application senses the beginning of the dwell period by comparing a low coil signal to a significant fraction of the actual battery voltage of the engine under test, which fraction will always exceed any low coil voltage which could exist during the dwell period. This system therefore accommodates old fashioned breaker-point ignition systems and a wide variety of different modern high voltage ignition systems, which use electronic switching in place of the old breaker points, with high battery voltage or with a poor battery during cranking.

The system of the foregoing application, and numerous other systems for conditioning the signal of the ignition coil primary, cannot be used to provide ignition coil primary signal conditioning for ignition systems which are positively switched (that is, in which the high side or battery side of the coil is switched rather than the low or ground side).

SUMMARY OF THE INVENTION

Objects of the present invention include provision of signal conditioning for ignition systems equally effective with positively switched coil primaries and negatively switched coil primaries; and provision of compatible signal conditioning for positively switched and negatively switched ignition systems, without knowlede of or special adaptation to the particular type of system under test.

According to the present invention, signal conditioning of voltages at the primary of the ignition coil of a spark ignition engine, so as to provide discrete indications of the beginning and ending of dwell time therein, is accomplished compatibly in positively switched and negatively switched ignition systems by concurrently comparing the high coil signal against a negative voltage which is more negative than any which could occur in a negatively switched system but is indicative of the end of dwell period in a positively switched system, and comparing the low coil voltage against a voltage which is more positive than any which will exist in a positively switched system but is indicative of the end of dwell time in a negatively switched system; and, in order to recognize the beginning of dwell time, which are higher than any voltage normally occurring during dwell time of either negatively switched or positively switched ignition systems, by requiring that both high coil and low coil be less than respective voltage thresholds, the high coil being compared against a fixed voltage and the low coil signal being compared against a substantial fraction of battery voltage.

BRIEF DESCRIPTION OF THE DRAWING

FIG. 1 is a series of illustrations of high and low coil input signals and the output signal, on a common time base;

FIG. 2 is a schematic illustration of a negative switching ignition system;

FIG. 3 is a schematic illustration of a positive switching ignition system.

DETAILED DESCRIPTION

Figure 4:
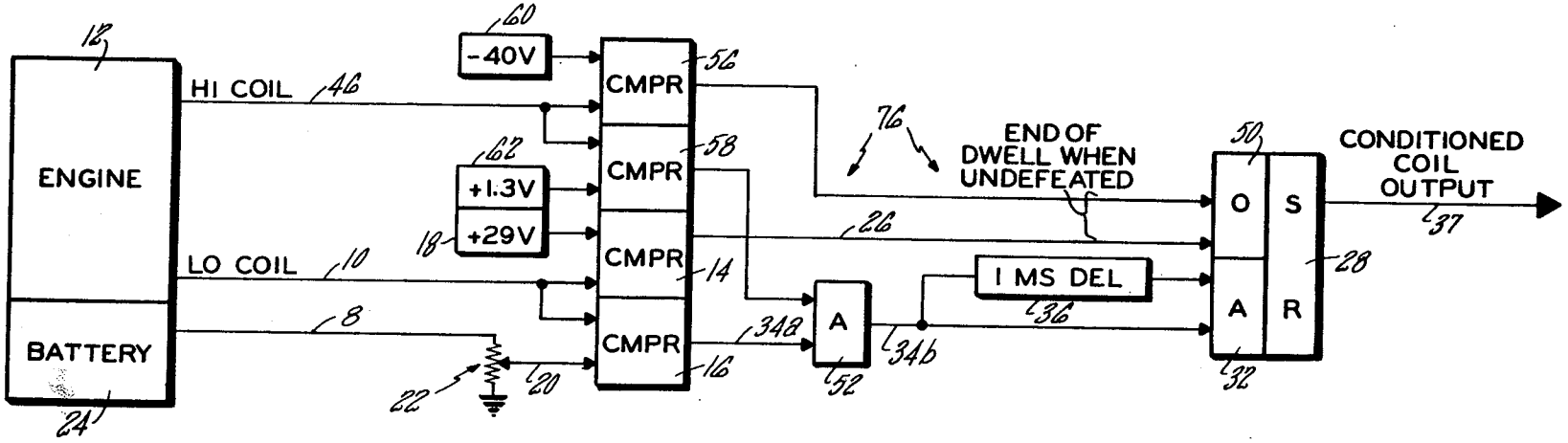
FIG. 4 is a schematic block diagram of an exemplary embodiment of the invention.

Referring now to illustration (*a*) of FIG. 1 and to FIG. 2, a typical ignition system of an engine 12 includes an autotransformer, usually referred to as the ignition coil 5 having a primary and a secondary, the primary being connected through a resistor 6 to a battery 24. The end of the primary which is connected through the resistor 6 to the battery 24 is typically referred to as high coil since it is the ungrounded end of the coil primary; the other end of the primary is typically referred to as low coil since it goes to the grounded or low voltage side of the system. In order to create high voltage in the spark, current is induced through the resistor 6 and the primary of the coil 5 by grounding low coil through a switching means 7, which in the early types of ignition systems comprises the well known cam-actuated breaker points which are shunted with a capacitor to prevent arcing across the points. In more modern systems, the switching means 7 may comprise any sort of electronic switches. The current in the primary builds up during the time that the switch 7 is closed, and when the switch 7 is open, the primary tries to maintain the current, and thus switches roles, acting as a generator with positive voltage at the bottom and negative voltage at the top, so that a large voltage build up exists across the primary to induce kilovolts in the secondary for operating the spark. In illustration (*a*) of FIG. 1, the voltage waveform of the low coil of a modern, electronically switched negative switching ignition system is shown. During dwell, the current builds up and the voltage may also rise at the high end of the electronic switch means 7 so as to limit the current through the primary; at the end of the dwell period (the beginning of firing time) the switch opens and the low coil voltage rises to several hundred volts in a typical case. This induces the high voltage in the secondary, and causes the spark in the igniters (spark plugs), followed by a ringing voltage which settles down near battery voltage, because the primary of the coil 5 is connected through the resistor 6 to the positive side of the battery 24, and no current is flowing when the spark extinguishes. As soon as the switch 7 is closed again at the beginning of dwell time, the low coil voltage drops to or near ground and then commences to rise once again as current in the primary goes up. In old fashioned breaker point systems, voltage of the low coil remains near ground throughout the dwell period.

In our aforementioned copending application, the firing time and dwell period of a negative switching ignition system are delineated with accurately developed square waves as shown in illustration (*c*) of FIG. 1. This is accomplished as illustrated herein in FIG. 4, utilizing the same reference numerals for similar elements as in our aforementioned copending application. In FIG. 4, the low coil signal on the line 10 is fed to a pair of compare circuits 14, 16. The compare circuit 14 is also fed by a fixed reference voltage from a reference voltage source 18; this may be on the order of +29 volts, in a typical diagnostic system, and is chosen so as to be higher than any low coil voltage which can exist during the dwell period yet lower than the maximum voltage (which may be on the order of 30 or 35 volts) which the low coil could achieve during ignition defeat (which, as is known allows taking ignition voltage and timing measurements during cranking while ensuring that the engine will not start). As set forth in the aforementioned copending application, the compare circuit 14 will work equally well with old fashioned breaker point systems or modern electronic switching systems, so long as they are switched on the low side of the coil primary, as illustrated in FIG. 2. The compare circuit 16 receives a signal indicative of a fraction of battery voltage (such as 9/10 of battery of voltage) on a line 20, which may be provided by a voltage divider 22 connected to a lead 8 from the battery 24. This comparison ensures that the beginning of dwell time is sensed by sensing the departure from the steady state battery voltage which occurs near the end of firing time, without regard to what the battery voltage is. For instance, if a fixed reference on the order of ten volts were used, the battery voltage could be less than that in the case of a very weak battery during cranking; on the other hand, in an electronic ignition system of an engine having a good electric system, which is operating at high rpms, the current-limited voltage near the end of dwell time could reach on the order of eight volts, so that any lower, fixed reference voltage could cause false sensing of the beginning of dwell time (actually at the end of dwell time). Thus, as set forth in our aforementioned copending application, having a test which floats with the battery voltage and is therefore always higher than any voltage which could occur during the end of dwell time, yet lower than the steady voltage at the end of firing time, allows sensing modern and older, breaker point systems, with weak batteries during cranking, or with good electrical systems while running.

When the compare circuit 14 determines that the high voltage swing is underway (at the start of firing time) it provides a signal on a line 26 which sets a bistable device 28 (through an OR circuit 50 referred to hereinafter), the output of which on a line 30 is the conditioned coil output which is desired, as is shown in illustration (*c*) of FIG. 1. And when the comparator 16 senses the beginning of dwell time, it provides a signal on a line 34*a*, which passes through an AND circuit 52, described hereinafter, to a line 34*b*. The signal on the line 34*b* is also passed through a millisecond delay circuit which, as described in the aforementioned copending application, will continuously provide a signal at its output so long as a signal is present at its input, commencing one millisecond after the signal is first applied to its input; any time a signal at its input disappears, the output disappears and the one millisecond delay must again expire after the presence of its input before there is an output signal once again. This simply causes a delay in the operation of the AND circuit 32 by one millisecond after appearance of the signal on the line 34*b*, which resets the bistable device 28, thus signaling the end of firing time as shown in illustration (*c*) of FIG. 1. The purpose of this one millisecond delay is to avoid resetting of the bistable device 28 as a result of negative swings in the ringing voltage near the start of firing time, which could be below 9/10 of battery voltage, but which (independent of engine speed) are always of less than one millisecond duration. This delay is a known expedient in the art and is described more fully in the aforementioned copending application; it does not form part of the present invention.

The description thus far is in accordance with the teachings of the aforementioned application, and it is limited to generating a well defined indication of dwell and firing time as is shown in illustration (*c*) of FIG. 1, related to an ignition system which switches the low side of the coil primary, of the type shown in FIG. 2.

The improvement according to the present invention provides a similar capability for generating a well defined, conditioned signal indicative of firing time and dwell in a positively switched system of the type shown in FIG. 3 and illustration (*b*) of FIG. 1. Therein, it is seen that the switching means 7 (whether it be breaker points or an electronic switch) is connected between the battery and the high end of the coil primary. As a consequence, the low coil signal is continuously connected to ground, and thus provides no indication at all of what is happening in the ignition system. Therefore, high coil must be sensed in order to define the dwell and firing time of the system. As seen in illustration (*b*) of FIG. 1, the positively switched system has a high coil voltage which starts off during dwell time (with the switch 7 closed) at essentially battery voltage, since there is zero current flow the moment the contact is closed; as current builds up in the primary, voltage drop across the resistor 6 causes the high coil voltage to decrease somewhat from battery voltage, in dependence upon the particular nature of the switch 7 (its internal impedance, etc.) and the value of the resistor 6. However, at the end of dwell time, when the switch 7 is opened, in an attempt to maintain current flow in the same direction as before, the coil primary now acts as a generator and attains a very high voltage, called the inductive kick, which generates kilovolts in the secondary so as to form the spark. This high voltage at the high coil end of the primary is negative rather than positive; it includes an initial spike, then it levels off somewhat, then it rings slightly around ground, and finally steadies out at ground near the end of firing time. This is due to the fact that high coil is connected through the primary directly to ground, and with no current flow or change thereof with respect to time, the high coil is at ground potential.

The improvement of the invention not only requires being able to sense a positively switched system of the type shown in FIG. 3 but also to sense either the negatively switched system of FIG. 2 or the positively switched system of FIG. 3, without even knowing which type of system is being sensed, and without altering connections or operation in order to accommodate whichever one it happens to be.

To achieve this, the high coil signal on the line 46 is applied to a pair of compare circuits 56, 58 which generally correspond respectively to the compare circuits 14, 16. The compare circuit 56 is also connected to a negative reference voltage from a source 60, which may be on the order of −40 volts, being a voltage which is lower, or more negative, than any voltage which the high coil signal will have other than during the initial portion of the spark-inducing voltage peak, but is less negative than the peak the high coil voltage might attain during ignition defeat. In this regard, the sensing of the high voltage spike of the high coil voltage in the positively switched system is analogous to the sensing of the high voltage spike of low coil voltage in the negatively switched system. The compare circuit 58 is also connected to a fixed reference voltage from a source 62, which may be on the order of +1.3 volts, which is chosen as a voltage higher than ground but definitely lower than any voltage which can occur during dwell time of a positively switched system, which could be on the order of 3–9 volts at the end of dwell time. When the comparator 56 senses the high negative swing (illustration (*b*) FIG. 1) it provides a signal to the OR circuit 52 which will set the bistable device to indicate firing time as seen in illustration (*c*) of FIG. 1. Then, at the end of firing time, the high coil voltage leaves ground and proceeds rapidly to battery voltage as a consequence of closing the switch 7, as is shown in illustration (*b*) of FIG. 1. The comparator 58 senses this and supplies a signal to the AND circuit 52 which causes initiation of the one millisecond delay and ultimately operates the AND circuit 32 as described hereinbefore with respect to the compare circuit 16 for the negatively switched system.

Comparing illustration (*c*) with the other illustrations of FIG. 1, it is obvious that firing time is extended by one millisecond and the delayed dwell is shortened by 1 millisecond, due to the one millisecond delay 36 in FIG. 4. This can be accommodated in a digital diagnostic system simply by subtracting a data word equivalent to the 1 millisecond delay from a data word indicating the extent of firing time, and adding the same amount to a data word indicating the extent of dwell time. Or, it could be accommodated in an analog fashion, by introducing a 1 millisecond delay to the end of the dwell period as shown in our aforementioned copending application, and providing suitable commensurate delay to the number one spark plug (or other engine signal times which are relevant); and, in many cases, the total of 1 millisecond delay in a corrected waveform is not important since only relative timing is desired. All of this is well within the skill of the art and not part of the present invention, as is described more fully in our copending application.

Thus, there has been described the generating of an accurate firing time/dwell signal in response to a negatively switched ignition system as in FIG. 2 (in accordance with the teachings of our copending application) as well as generation of such a signal in response to a positively switched ignition system as in FIG. 3. The present invention also attains the objective of being able to sense either ignition system without any knowledge as to which type it is sensing. This is achieved by connecting the circuitry of FIG. 4 to both high coil and low coil, without regard to which type of system is to be tested.

Consider first the case of a negatively switched system as in FIG. 2 and the fact that the high coil connections will not affect operation of the invention. First, the high coil signal on the line 46 will always be positive in the negatively switched system of FIG. 2, so that the compare circuit 56 will never operate. This leaves the OR circuit 50 responsive only to the output of the compare circuit 14 so that operation of the low coil signal is the only thing that will enable setting of the bistable device 28. And, the high coil signal is very close to battery voltage in the negatively switched system of FIG. 2 throughout the cycle, so that the compare circuit 58 always supplies an output to enable the AND circuit 52; thus the AND circuit 52 will be operable whenever a signal is presented on the line 34*a* by the compare circuit 16. Thus, whenever it is connected to a negatively switched system as illustrated in FIG. 2, the circuitry of FIG. 4 is responsive only to the low coil signals on the line 10 even though there is a high coil connection and there are the additional compare circuits 56, 58.

When the system is connected to a positively switched system as in FIG. 3, the low coil signal is always at ground. Since it is at ground, the compare circuit 14 will never operate. And since it is at ground, it will always be less than 9/10 of battery voltage, so the compare circuit 16 will continuously present a signal on the line 34*a*. This leaves the AND circuit 52 conditioned at all times to respond to the output of the compare circuit 58 whenever the high coil signal is above 1.3 volts. Stated alternatively, regardless of which system is being tested, the circuitry of FIG. 4 will respond appropriately, to either the signal line 54 or the signal line 10, in dependence upon whether it is connected to a positively switched system or to a negatively switched system. And, the other signal line will continuously enable the AND circuit 52 so as to permit the system to sense the beginning of dwell time, and its related comparator (56 or 14) will never operate so as not to interfere with the desired comparator (14 or 56) in its operation of the OR circuit 50. Thus, not only will the invention test either type of system but the circuitry for testing one type of system does not interfere with the circuitry for testing the other, and either type can be automatically tested without any adjustment in the invention itself, and without knowledge of which type of system is being tested.

Throughout the foregoing description, the examples of FIGS. 2 and 3 have been utilized in which the negative side of the battery is grounded. Obviously, if a positive ground system were involved, similar circuitry arranged with similarly chosen threshold values for the reference voltage sources could be utilized. Therefore, although described herein in terms of negatively switched systems and positively switched systems, these terms should be understood to mean switched at the grounded end and switched at the ungrounded end, respectively, and apply equally to ignition systems having a positive ground in which the high side is negative and the low side is positive, with suitable adjustments of polarity only. The small positive reference voltage of source 62 could be a small fraction of battery voltage, if desired, instead of being fixed. Similarly, although the invention has been shown and described with respect to exemplary embodiments thereof, it should be understood by those skilled in the art that the foregoing and various other changes, omissions and additions may be made therein and thereto, without departing from the spirit and the scope of the invention.

Having thus described a typical embodiment of our invention, that which we claim as new and desire to secure by Letters Patent is:

1. Apparatus for generating an accurate signal representation of the dwell and firing time of a spark ignition engine in which the ignition coil primary may be switched either at the grounded end or the ungrounded end, comprising:

first means for comparing the low coil signal against a positive reference voltage which is between the highest voltage that the low coil signal can reach in the dwell period and the lowest peak voltage which the low coil signal can reach during ignition-defeated operation in a negatively switched ignition system to provide a first signal related in time to the end of dwell period;

second means for comparing the low coil signal against a reference voltage which is between the most negative voltage that the high coil signal can reach in the dwell period and the lowest negative peak voltage which the low coil signal can reach during ignition-defeated operation in a positively switched ignition system to provide a second signal related in time to the end of a dwell period;

third means for comparing the low coil signal against a substantial faction of the voltage of the battery of the engine to provide a third signal related in time to the beginning of the dwell period;

fourth means for comparing the high coil signal against a small positive reference voltage which is lower than any voltage which occurs within the dwell period of a positively switched ignition system to provide a fourth signal related in time to the beginning of the dwell period; and output means connected for response to said first, second, third and fourth means, and operative at the end of dwell period in response to either said first signal or said second signal and operative at the end of the dwell period in concurrent response to both said third signal and said fourth signal, for providing a signal delineating the dwell period from the firing time without regard to whether the ignition system under test is positively switched or negatively switched.

2. Apparatus according to claim 1 wherein said output means comprises means settable into either one of two stable states, said means when set in a first one of said states delineating a period of time relating to the firing time and when set in the other of said states delineating a period of time related to the dwell period, said bistable means being settable in said first state in response to either said first signal or said second signal and being settable into the other of said states only following concurrent presence of said third signal and said fourth signal.

* * * * *